US006209434B1

(12) United States Patent
Kim et al.

(10) Patent No.: US 6,209,434 B1
(45) Date of Patent: Apr. 3, 2001

(54) PAPER SHEET DECORATIVE PUNCHING DEVICE

(75) Inventors: Ok H. Kim; Wan Y. Oh, both of Seoul (KR)

(73) Assignee: DN Craft Corporation, Seoul (KR)

( * ) Notice: Subject to any disclaimer, the term of this patent is extended or adjusted under 35 U.S.C. 154(b) by 0 days.

(21) Appl. No.: 09/357,928

(22) Filed: Jul. 21, 1999

(30) Foreign Application Priority Data

Aug. 13, 1998 (KR) ..... 98-32837

(51) Int. Cl.[7] ..... B26F 1/04

(52) U.S. Cl. ..... 83/549; 83/468.5; 83/687; 83/691; 83/620; 30/358

(58) Field of Search ..... 30/360, 358, 367, 30/315, 316, 277, 293; 83/620, 549, 687, 691, 468.3, 468.5, 468.6, 468.7; 234/44, 131

(56) References Cited

U.S. PATENT DOCUMENTS

| | | | | |
|---|---|---|---|---|
| 2,482,218 | * | 9/1949 | Segal | 83/687 X |
| 2,524,344 | * | 10/1950 | English | 83/468.7 X |
| 2,638,986 | * | 5/1953 | Emmer | 83/687 X |
| 4,572,444 | * | 2/1986 | Shadduck | 30/316 X |
| 4,967,628 | * | 11/1990 | Judd et al. | 83/468.6 X |
| 5,495,671 | * | 3/1996 | Shun-Yi | 30/358 X |
| 5,647,278 | * | 7/1997 | Wu | 30/358 X |
| 5,740,712 | * | 4/1998 | Watkins et al. | 83/687 X |
| 5,755,148 | * | 5/1998 | Stumpf et al. | 83/468.6 X |
| 5,816,129 | * | 10/1998 | Singer | 83/468.3 |
| 6,000,139 | * | 12/1999 | Chan | 30/358 |

FOREIGN PATENT DOCUMENTS

| | | | | |
|---|---|---|---|---|
| 671592 | * | 5/1952 | (GB) | 30/358 |
| 20-1996-0028444 | | 9/1996 | (KR) . | |

* cited by examiner

*Primary Examiner*—Rinaldi I. Rada
*Assistant Examiner*—Charles Goodman
(74) *Attorney, Agent, or Firm*—McGuireWoods LLP

(57) ABSTRACT

A paper sheet decorative punching device is disclosed. In the punching device, a cap-shaped pressure member is movably received in an opening of a housing with two longitudinal guide pieces vertically extending from the lower edge of the pressure member. A punching blade unit, allowing the pressure member to be rotatable within a range, has two punching blade parts. The two blade parts have different punching patterns and different lengths. Both the pressure unit and the punching blade unit are biased upwardly by a compression coil spring, and so the pressure unit is normally projected from the top of the housing. Two edge guide members are symmetrically hinged to a base plate and are adjustable between a closed position for guiding a sheet's corner and an open position for guiding a sheet's side. A jig unit, seated on the base plate, consists of an upper holder member and a lower cutting member, with a paper sheet insert gap being formed between the two members. The holder member has two blade guide holes and two guide slots. The guide pieces of the pressure unit are selectively aligned with the guide slots in accordance with a rotated position of the pressure member. The cutting member has two cutting holes at positions corresponding to the two blade guide holes.

11 Claims, 4 Drawing Sheets

PAPER SHEET DECORATIVE PUNCHING DEVICE

BACKGROUND OF THE INVENTION

1. Field of the Invention

The present invention relates, in general, to paper sheet decorative punching devices and, more particularly, to a punching device designed to cut or punch a desired portion, such as a corner or a linear side, of a paper sheet, such as a photograph, a card or a letter paper, utilizing two or more different pattern punching blades, thus decorating such paper sheets.

2. Description of the Prior Art

In a conventional paper sheet decorative punching device, a cutting hole is formed on the center of a lower fixed base. A punch holder is mounted to one end of the fixed base and is positioned to be normally spaced apart from the base at an interval. A punching blade guide hole, corresponding to the cutting hole of the base, is formed at the center of the punch holder. A spring-biased punching blade member, having a decorative pattern and a diameter slightly smaller than that of both holes, is held on the punch holder in a way such that the lower end of the blade member is normally positioned within the punching blade guide hole. A pressure plate is integrated with the upper end of the blade member. The punch holder is assembled with a housing having a pressure button hole, with a pressure button being set within the housing so as to be positioned on the pressure plate.

However, such a conventional punching device is designed to cut or punch a portion of a paper sheet utilizing one punching blade member, having a fixed decorative pattern, without allowing a user to freely form a variety of pattern holes on the paper sheet.

Therefore, the conventional punching device forces a user, wanting to form a variety of decorative pattern holes on a paper sheet, to separately purchase a plurality of punching devices with punching blade members having differently designed patterns. This is inconvenient to the user while making the user exceedingly waste money to purchase the devices. In addition, the conventional decorative punching devices are free from any guide means designed to appropriately set each corner of a paper sheet relative to the punching device when it is necessary to form a decorative pattern hole on each corner of the paper sheet, such as a rectangular photograph or a rectangular card. Therefore, the punched holes of the paper sheet may be not formed on corresponding positions and fail to desirably decorate the paper sheet.

In an effort to solve the above-mentioned problems, Korean U.M. Laid-open publication No. 98-15229 discloses a decorative punching device having four different decorative punching patterns around a punching blade member. Four guide members are diagonally formed on a die which is provided with a cutting hole having the same profile as that of the blade member. A punch holder, with a guide hole having the same profile as that of the blade member, is integrated with the upper end of the guide members. In this punching device, the four guide members form four paper sheet insert means. The above punching device thus easily and appropriately cuts or punches the corners of a paper sheet due to the four guide members. However, this decorative punching device is problematic in that it is impossible to form any additional decorative pattern on the corners after the corners are primarily cut or punched by the device.

SUMMARY OF THE INVENTION

Accordingly, the present invention has been made keeping in mind the above problems occurring in the prior art, and an object of the present invention is to provide a paper sheet decorative punching device, which is designed to selectively cut the corners of a paper sheet or punch any desired portion of the sheet and to perform a punching operation for the corners of a paper sheet utilizing two different pattern punching blade parts at the same time.

In order to accomplish the above object, the present invention provides a paper sheet decorative punching device, comprising: a housing having a specifically designed profile, the housing including: a circular opening defined by a stop ring at a top end of the housing; and a cylindrical seat interiorly formed in a lower portion of the housing while communicating with the circular opening; a pressure unit movably held in the housing, the pressure unit consisting of: a cap-shaped pressure member having an annular stop flange along its lower edge and movably received in the opening of the housing with the stop flange being stopped by the stop ring of the housing; and two or more longitudinal guide pieces integrally extending from the lower edge of the pressure member downwardly to a length at diametrically opposite positions; a punching blade unit adapted for punching a paper sheet, the punching blade means consisting of: a flat plate positioned under a top wall of the pressure member and having two or more guide notches at diametrically opposite positions so as to allow the guide pieces of the pressure unit to be movable within a predetermined range, thus allowing the pressure member to be rotatable within the range; and first and second punching blade parts integrally extending from a lower surface of the flat plate downwardly in a vertical direction, the first and second blade parts having different punching patterns and different lengths; elastic means for normally biasing both the pressure unit and the punching blade unit upwardly, thus letting the pressure unit be normally and elastically projected from the housing upwardly; a base unit assembled with the lower end of the housing and used for holding the device on a flat support surface, the base unit consisting of: a base plate having the same profile as that of the lower end of the housing and having both a seat and a cutout discharging hole; and two edge guide members symmetrically hinged to the base plate using hinge joints and adapted for guiding an edge of the paper sheet during a punching operation, the edge guide members individually having both an edge contact blade at one side thereof and a stop shoulder at a position around the hinge joint; and a jig unit supported on the base unit and consisting of: a holder member seated within the cylindrical seat of the housing and provided with first and second guide holes for guiding the two punching blade parts, the holder member also having diametrically opposite guide slots for selectively guiding the guide pieces of the pressure unit; and a cutting member seated in the seat of the base plate and having first and second cutting holes at positions corresponding to the first and second guide holes of the holder member, the cutting member being assembled with the holder member by a connection plate, the connection plate having a bent plate portion forming a paper sheet insert gap between the cutting member and the holder member.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
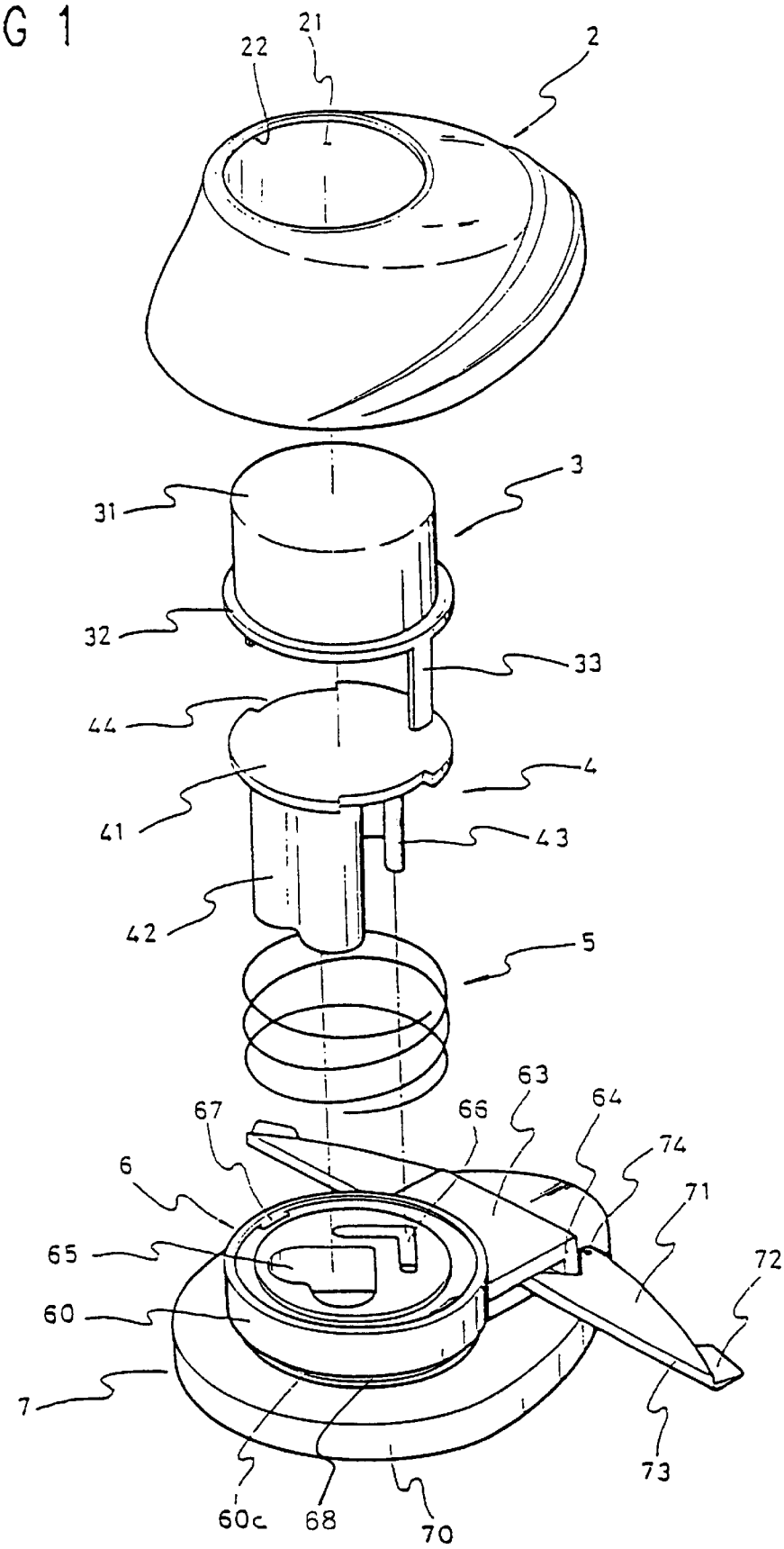
FIG. 1 is an exploded perspective view of a paper sheet decorative punching device in accordance with the preferred embodiment of the present invention.
Figure 2:
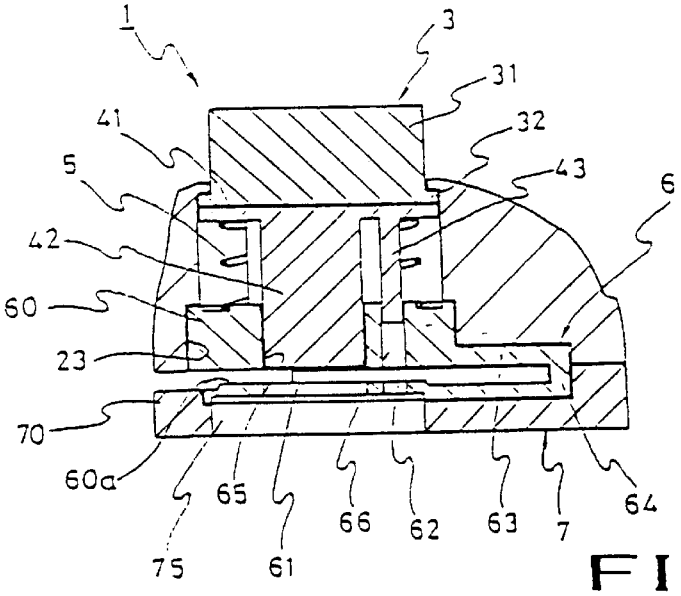
FIG. 2 is a front sectional view of the punching device of this invention.

FIG. 1 is an exploded perspective view of a paper sheet decorative punching device in accordance with the preferred embodiment of this invention. FIG. 2 is a front sectional view of the above punching device. As shown in the drawings, the paper sheet decorative punching device 1 of this invention comprises a housing 2 having a specifically designed appearance. A pressure unit 3 is movably set in the housing 2. The punching device 1 also has a decorative punching blade unit 4 used for forming one or two different pattern holes on a paper sheet. An elastic means 5 normally biases both the pressure unit 3 and the punching blade unit 4 upwardly, thus letting the pressure unit 3 be normally and elastically projected from the top wall of the housing 2 upwardly. The punching device 1 further comprises a jig unit 6 with a paper sheet insert gap 68 and blade guide holes 65 and 66 having the same profile as the cross-sectioned profile of the punching blade unit 4. A base unit 7 is assembled with the jig unit 6. The above base unit 7 is used for holding a paper sheet inserted into the paper sheet insert gap 68 of the jig unit 6, thus preventing the paper sheet from being undesirably moved during an operation of the punching device.

In a detailed description, the housing 2 has a specifically designed configuration, such as a conventional punch shape, an animal shape or a shoe shape, thus having an attractive design. The above housing 1 has a circular opening 21 through which a cap-shaped pressure member 31 of the pressure unit 3 passes upwardly so as to be projected from the opening 21 upwardly. The above opening 21 is defined by a stop ring 22 at the top end of the housing 1. A cylindrical seat 23 is interiorly formed in the lower portion of the housing 1 while communicating with the circular opening 21. The above seat 23 is used for seating a holder member 60 therein as will be described later herein.

The pressure unit 2 comprises the cap-shaped pressure member 31 movably received in the opening 21 of the housing 1 upwardly. The pressure member 31 has an annular stop flange 32 along its lower edge, and so the member 31 is stopped by the stop ring 22 of the opening 21 at the stop flange 32 when it is biased upwardly. The pressure member 31 is thus prevented from being undesirably separated from the housing 1. Two or more longitudinal guide pieces 33 integrally extend from the lower edge of the pressure member 31 downwardly in a vertical direction to a length at diametrically opposite positions.

Figure 3:
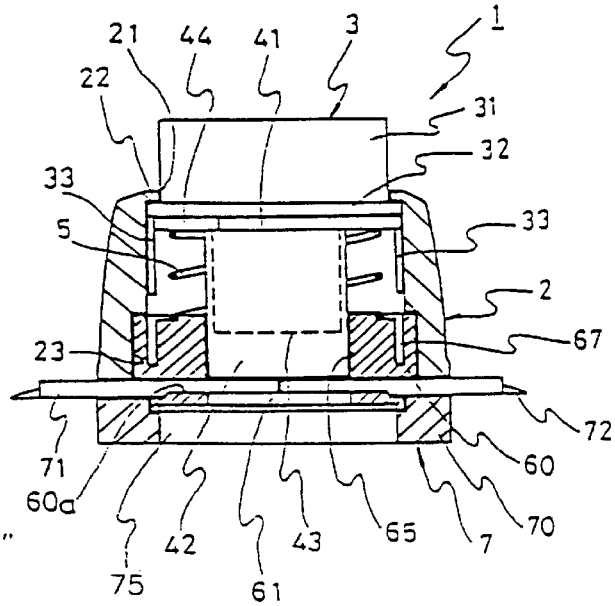
FIG. 3 is a side sectional view of the punching device of this invention.

The punching blade unit 4 comprises a flat plate 41 which is closely positioned under the top wall of the cap-shaped pressure member 31. As shown in FIG. 3, the flat plate 41 has two or more guide notches 44 at diametrically opposite positions so as to allow the guide pieces 33 of the pressure unit 3 to be movable within a predetermined range. That is, the guide notches 44 limits a rotating action of the pressure unit 3 within a range. Two blade parts, first and second punching blade parts 42 and 43, are integrally formed on the lower surface of the flat plate 41.

In order to accomplish the object of this invention, the first and second blade parts 42 and 43 of the blade unit 4 have different lengths. In the preferred embodiment, the blade unit 4 is designed so that the first part 42 is longer than the second part 43. However, it should be understood that the blade unit 4 may be designed so that the first part 42 is shorter than the second part 43 without affecting the functioning of this invention.

The elastic means 5 normally biases both the pressure unit 3 and the blade unit 4 upwardly, thus letting the pressure unit 3 be normally and elastically projected from the opening 21 of the housing 1 upwardly. In the preferred embodiment, the elastic means 5 comprises a compression coil spring which normally biases both the pressure unit 3 and the blade unit 4 upwardly. The pressure unit 3 is thus moved down along with the blade unit 4 while overcoming the spring force of the compression coil spring 5 when the unit 3 is pressed down by a user at a position outside the housing 1. Of course, when an external pressing force is removed from the pressure unit 3, the unit 3 elastically returns to its original position or the fully projected position along with the blade unit 4 due to the restoring force of the compression coil spring 5. In the preferred embodiment, the first and second blade parts 42 and 43 of the blade unit 4 are commonly fitted within the coil spring 5, with the top end of the spring 5 being stopped by the lower surface of the flat plate 41.

The base unit 7 comprises a base plate 70 having the same profile as that of the lower end of the housing 1. As shown in FIG. 3, the base plate 70 seats a cutting member 60*a* of the jig unit 6 therein, with a cutout discharging hole 75 being formed at the center of the base plate 70. Two edge guide members 71 are symmetrically hinged to the top surface of the base plate 70 using hinge joints 74. The edge guide members 71 individually have both an edge contact blade 73 at one side thereof and a stop shoulder 76 at a position around the hinge joint 74. The edge guide members 71 also include outward extending tabs 72 at an end opposite the stop shoulder 76. During an operation of the punching device 1, the edge guide members 71 are brought into contact with the edge of a paper sheet 100 at the edge contact blades 73. The edge guide members 71 are symmetrically rotatable around the hinge joints 74 between a fully open position with the contact blades 73 forming a straight line or an angle of 180° and a fully closed position with the contact blades 73 forming a right angle between them.

The jig unit 6, supported on the base unit 7, comprises a holder member 60 which is provided with first and second guide holes 65 and 66 for guiding the two punching blade parts 42 and 43. Two or more diametrically opposite guide slots 67 are formed on the holder member 60 to guide the two or more guide pieces 33 of the pressure unit 3. The jig unit 6 also has a cutting member 60*a*. In the cutting member 60*a*, first and second cutting holes 61 and 62 are formed at positions corresponding to the first and second guide holes 65 and 66 of the holder member 60. The cutting member 60*a* is assembled with the holder member 60 by a connection plate 63. The connection plate 63 has a bent plate portion 64 forming a paper sheet insert gap 68 between the cutting member 60*a* and the holder member 60.

The operation effect of the punching device 1 of this invention will be described hereinbelow.

Figure 5A:
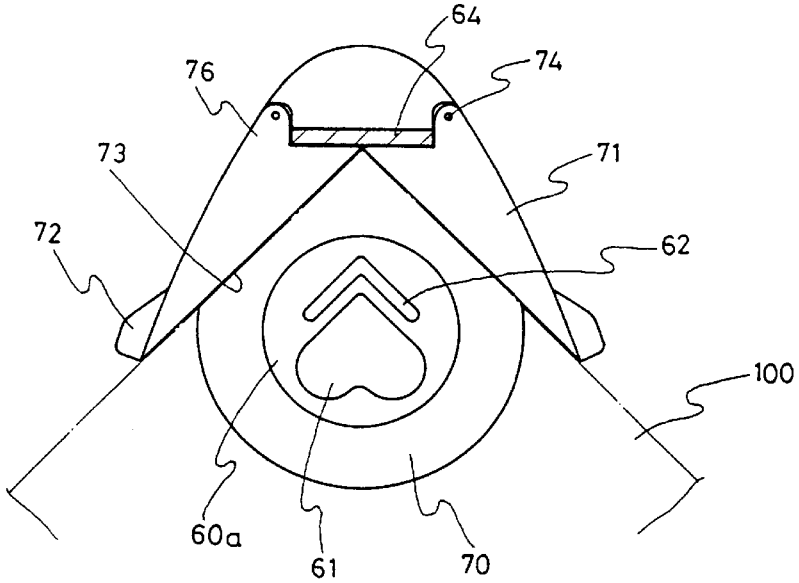
FIG. 5*a* is a plan view, showing a paper sheet guide operation of two hinged edge guide members included in the device of this invention when the device performs a punching operation for a corner of a paper sheet.
Figure 5B:
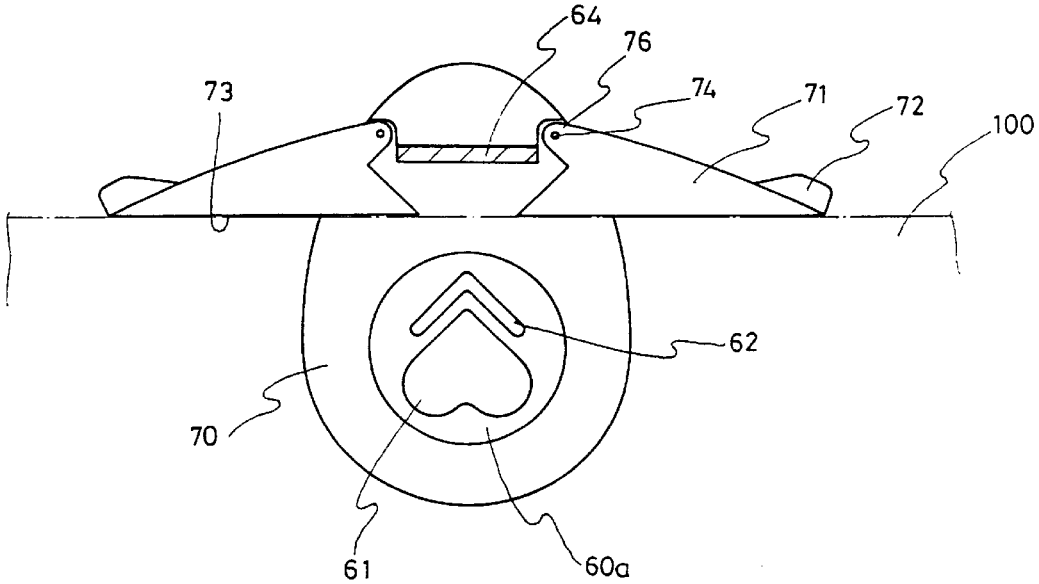
FIG. 5*b* is a plan view, showing a paper sheet guide operation of the two hinged edge guide members when the device performs a punching operation for a linear side of a paper sheet.

In order to perform a punching operation exclusively using the first blade part 42, the device 1 is primarily laid on a flat support surface. Thereafter, the edge guide members 71 is adjusted to meet the edge of a paper sheet 100. In such a case, the guide members 71 may be rotated around the hinged joints 74 to the closed position as shown in FIG. 5*a* or to the open position as shown in FIG. 5*b*. In the open position of FIG. 5*b*, the stop shoulders 76 of the guide members 71 are stopped by the bent plate portion 64 of the connection plate 63, thus preventing the guide members 71 from being further opened. When the edge guide members 71 are adjusted to the closed position as shown in FIG. 5*a*, a desired corner of the paper sheet 100 is inserted into the paper insert gap 68 of the jig unit 6 with the corner edges of the sheet 100 substantially meeting the edge contact blades 73 of the two guide members 71. On the other hand, When the edge guide members 71 are adjusted to the open position as shown in FIG. 5*b*, a side of the paper sheet 100 is inserted into the paper insert gap 68 with the linear edge of the sheet 100 substantially meeting the edge contact blades 73.

Figure 4:
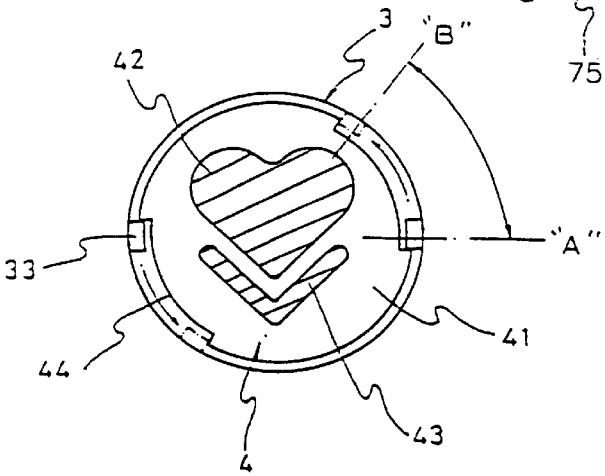
FIG. 4 is a bottom view of a decorative punching blade unit included in the device of this invention.

After adjusting the edge guide members 71 and setting the paper sheet 100 in the punching device 1, the pressure member 31 is rotated counterclockwise from a position A to a position B of FIG. 4. In such a case, the guide pieces 33 of the pressure member 31 move within the guide notches 44 of the blade unit 4 in the same direction until they are stopped by one edge of the notches 44.

Figure 6A:
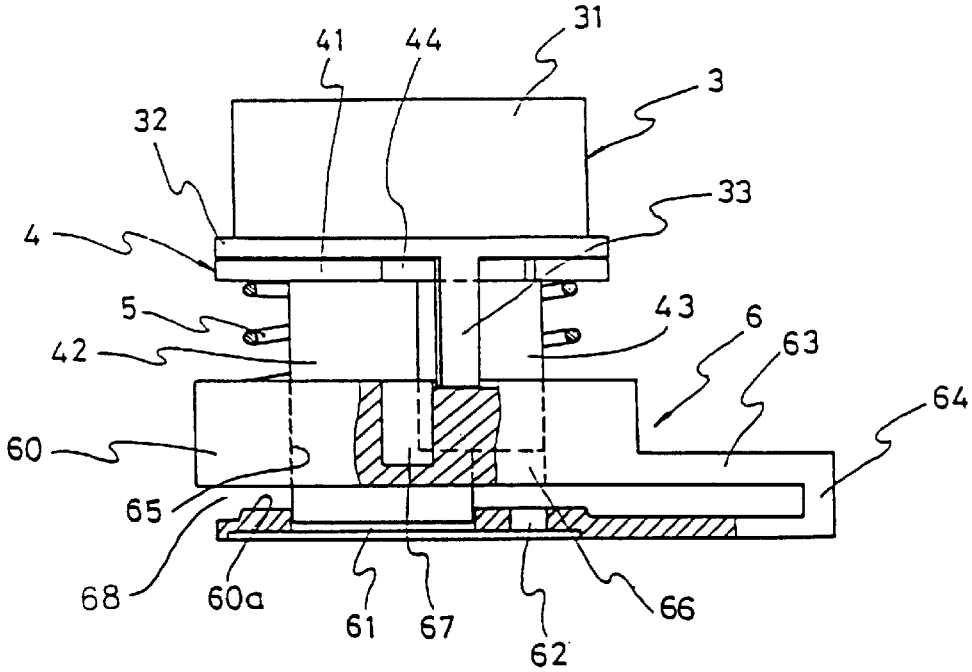
FIG. 6*a* is a sectional view, showing a punching operation of the device exclusively utilizing a first punching blade part included in the blade unit of FIG. 4.
Figure 6B:
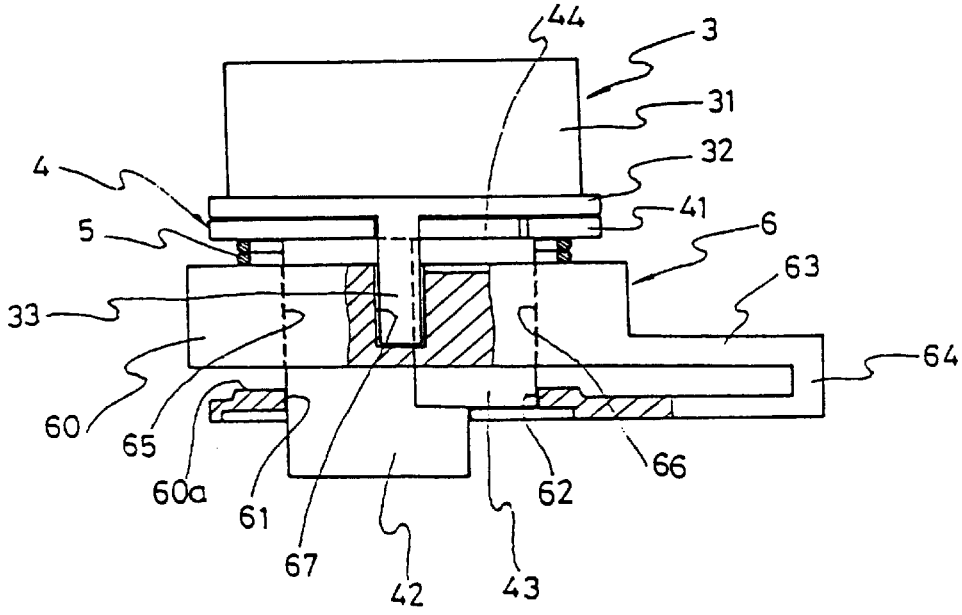
FIG. 6*b* is a sectional view, showing a punching operation of the device utilizing first and second punching blade parts included in the blade unit of FIG. 4.

After the pressure member 31 is completely rotated, it is pressed down by a user, thus being lowered along with the blade unit 4 while compressing the elastic means 5 as shown in FIG. 6*a*. In such a case, the compression of the elastic means 5 is accomplished by the flat plate 41 which is pressed down along with the pressure member 31. The first and second blade parts 42 and 43 of the blade unit 4 are thus lowered within the first and second guide holes 65 and 66 of the holder member 60 seated in the cylindrical seat 23 of the housing 1.

Such a lowering action of both the pressure unit 3 and the blade unit 4 is continued until the guide pieces 33 of the pressure member 31 are brought into contact with and are stopped by the top surface of the holder member 60. In such a case, only the first blade part 42 of the blade unit 4 is substantially long enough to completely pass through the first guide hole 65 prior to passing through the sheet 100 and being inserted into the first cutting hole 61 of the cutting member 60*a*. However, the second blade part 43 is short, and so it fails to completely pass through the second guide hole 66 of the holder member 60. Therefore, the punching device 1 in this operation punches the paper sheet 100 utilizing only the first blade part 42 and forms a decorative pattern hole, provided by the first blade part 42, on the sheet 100.

When an external pressing force is removed from the pressure member 31, the member 31 elastically returns to its original position or the fully projected position along with the blade unit 4 due to the restoring force of the compression coil spring 5. In such a case, the pressure member 31 is stopped by the stop ring 22 of the housing 1 at the stop flange 32, thus being retained at the fully projected position without being undesirably separated from the housing 1.

In order to perform a punching operation using both the first and second blade parts 42 and 43 at the same time, the pressure member 31 is rotated clockwise from the position B to the position A of FIG. 4. In such a case, the guide pieces 33 of the pressure member 31 move within the guide notches 44 of the blade unit 4 in the same direction until they are stopped by the other edge of the notches 44. Thereafter, the pressure member 31 is pressed down by a user, thus being lowered along with the blade unit 4 while compressing the elastic means 5.

The first and second blade parts 42 and 43 of the blade unit 4 are thus lowered within the first and second guide holes 65 and 66 of the holder member 60. In such a case, the guide pieces 33 of the pressure member 31 are positioned to be aligned with the guide slots 67 of the holder member 60, and so the pressure unit 3 and the blade unit 4 are further lowered by a length equal to the depth of each guide slot 67 in comparison with the above-mentioned punching operation utilizing only the first blade part 43.

Therefore, in addition to the longer first blade part 42 completely passing through the first guide hole 65 prior to being inserted into the first cutting hole 61 of the cutting member 60*a*, the shorter second blade part 43 completely passes through the second guide hole 66 of the holder member 60 prior to being inserted into the second cutting hole 62 of the cutting member 60*a*. Therefore, the punching device 1 punches the paper sheet 100 utilizing the first and second blade parts 42 and 43 and forms two different decorative pattern holes, respectively provided by the two blade parts 42 and 43, on the sheet 100 at a time.

That is, the punching device 1 of this invention is designed to form one or two different decorative pattern holes on a paper sheet in accordance with a rotated position of a pressure unit 3. This object is accomplished by a punching blade unit 4 with two blade parts, or first and second parts 42 and 43 having different lengths. In the present invention, the blade unit 4 may be designed so that the first blade part 42 is longer than the second part 43 as described for the preferred embodiment. However, it should be understood that the blade unit may be designed so that the second blade part is longer than the first part.

As described above, the present invention provides a paper sheet decorative punching device. The punching device is designed to cut or punch a desired portion, such as a corner or a linear side, of a paper sheet, such as a photograph, a card or a letter paper, utilizing two different pattern punching blades, thus decorating such paper sheets. The punching device also allows a user to form any additional decorative pattern on a paper sheet after the sheet is primarily cut or punched by the device. Another advantage of the punching device resides in that it selectively forms two different decorative pattern holes on a paper sheet at a time when necessary.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A paper sheet decorative punching device, comprising:

a housing having a lower end and a specifically designed profile, the housing including:

a circular opening defined by a stop ring at a top end of the housing; and a cylindrical seat interiorly formed in the lower end of the housing while communicating with the circular opening;

a pressure unit movable held in the housing, the pressure unit comprising:

a cap-shaped pressure member having an annular stop flange along a lower edge of the cap-shaped pressure member and movably received in opening of the housing with the annular stop flange being stopped by the stop ring of the housing; and two or more longitudinal guide pieces integrally extending from the lower edge of the cap-shaped pressure member downwardly to a length at diametrically opposite positions;

a punching blade unit adapted for punching a paper sheet, the punching blade unit comprising:

a flat plate positioned below the annular stop flange of the cap-shaped pressure member and having two or more guide notches at diametrically opposite positions so as to allow the guide pieces of the pressure unit to be movable within a predetermined range, thus allowing the cap-shaped pressure member to be rotatable within the range; and first and second punching blade parts integrally extending downwardly from a lower surface of the flat plate in a vertical direction, the first and second blade parts having different punching patterns and different lengths;

elastic means for normally biasing both the pressure unit and the punching blade unit upwardly, thus allowing the pressure unit tube normally and elastically projected upwardly from the housing;

a base unit assembled with the lower end of the housing and used for holding the device on a flat support surface, the base unit comprising:

a base plate having a same profile as the lower end of the housing and having both a seat and a cutout discharging hole; and two edge guide members symmetrically hinged to the base plate using hinge joints and adapted for guiding an edge of the paper sheet during a punching operation, the edge guide members individually having both an edge contact blade at one side thereof and a stop shoulder at a position around the hinge joint; and a jig unit supported on the base unit and comprising:

a holder member seated within the cylindrical seat of the housing and provided with first and second guide holes for guiding the two punching blade parts, the holder member also having diametrically opposite guide slots for selectively guiding the guide pieces of the pressure unit; and a cutting member seated in the seat of the base plate and having first and second cutting holes at positions corresponding to the first and second guide holes of the holder member, the cutting member being assembled with the holder member by a connection plate, the connection plate having a bent plate portion forming a paper sheet insert gap between the cutting member and the holder member.

2. The paper sheet decorative punching device according to claim 1, wherein said guide pieces of the pressure unit are selectively positioned on a top surface of said holder member at a position outside the guide slots by a rotating action of said pressure member, thus being stopped by the top surface of the holder member and only allowing a longer one of the first and second punching blade parts to be inserted into an associated cutting hole of the cutting member after punching the paper sheet.

3. The paper sheet decorative punching device according to claim 1, wherein said guide pieces of the pressure unit are selectively positioned on a top surface of said holder member at a position aligned with the guide slots by a rotating action of said pressure member, thus being receivable into said holder member and allowing both the first and second punching blade parts to be inserted into the first and second cutting holes of the cutting member after punching the paper sheet.

4. The paper sheet decorative punching device according to claim 1, wherein said two edge guide members are symmetrically rotatable around the hinge joints between a fully open position with the edge contact blades forming a straight line and a fully closed position with the edge contact blades forming a right angle between them.

5. A paper sheet decorative punching device, comprising:

a housing having a lower end and a top end comprising:

a circular opening defined by a stop ring at the top end of the housing; and a cylindrical seat formed in interior of the cylindrical seat at the lower end thereof;

a pressure unit movable held in the housing, the pressure unit comprising:

a pressure member having a flange along a lower edge of the pressure member and movably received in the opening of the housing with the flange being stopped by the stop ring of the housing; and at least two longitudinal guide pieces extending from the lower edge of the pressure member downwardly to a length at diametrically opposite positions;

a punching blade unit adapted for punching a paper sheet, the punching blade unit comprising:

a flat plate positioned below the flange of the pressure member and having at least two guide notches at diametrically opposite positions which communicate with the at least two longitudinal guide pieces so that the pressure member is rotatable within a range defined by the at least two notches; and first and second punching blade parts extending downwardly from a lower surface of the flat plate, the first and second blade parts having different lengths;

elastic means for biasing the pressure unit and the punching blade unit upwardly toward the housing;

a base unit assembled with the lower end of the housing and holding the device on a flat support surface, the base unit comprising:

a base plate communicating with the lower end of the housing and having both a seat and a cutout discharging hole; and a jig unit supported on the base unit and comprising:

a holder member seated within the cylindrical seat of the housing and provided with first and second guide holes for guiding the two punching blade parts, the holder member also having diametrically opposite guide slots for selectively guiding the guide pieces of the pressure unit; and a cutting member seated in the seat of the base plate and having first and second cutting holes positioned corresponding to the first and second guide holes of the holder member, the cutting member being assembled with the holder member by a connection plate forming a paper sheet insert gap between the cutting member and the holder member.

6. The paper sheet decorative punching device according to claim 5, further comprising two edge guide members symmetrically hinged to the base plate using hinge joints and adapted for guiding an edge of the paper sheet during a punching operation.

7. The paper sheet decorative punching device according to claim 6, wherein the edge guide members individually having both an edge contact blade at one side thereof and a stop shoulder at a position around the hinge joint.

8. The paper sheet decorative punching device according to claim 5, wherein the connection plate includes a bent plate portion forming the paper sheet insert gap.

9. The paper sheet decorative punching device according to claim 5, wherein the first and second punching blade parts have different punching patterns.

10. The paper sheet decorative punching device according to claim 5, wherein the flange is an annular stop flange.

11. The paper sheet decorative punching device according to claim 5, wherein the pressure member is a cap-shaped pressure member.

* * * * *